US005356766A

United States Patent [19]

Idogaki

[11] Patent Number: 5,356,766

[45] Date of Patent: Oct. 18, 1994

[54] SILVER HALIDE PHOTOGRAPHIC LIGHT-SENSITIVE MATERIAL

[75] Inventor: Yoko Idogaki, Kanagawa, Japan

[73] Assignee: Fuji Photo Film Co., Ltd., Kanagawa, Japan

[21] Appl. No.: 186,891

[22] Filed: Jan. 27, 1994

Related U.S. Application Data

[63] Continuation of Ser. No. 993,608, Dec. 21, 1992, abandoned.

[30] Foreign Application Priority Data

Dec. 19, 1991 [JP] Japan ..... 3-353948

[51] Int. Cl.[5] ..... G03C 1/06; G03C 1/825

[52] U.S. Cl. ..... 430/522; 430/598

[58] Field of Search ..... 430/264, 522, 598

[56] References Cited

U.S. PATENT DOCUMENTS

| | | | |
|---|---|---|---|
| 4,092,168 | 5/1978 | Lemahieu et al. | 430/522 |
| 4,988,611 | 1/1991 | Anderson et al. | 430/522 |
| 4,996,138 | 2/1991 | Murai et al. | 430/522 |
| 5,006,445 | 4/1991 | Yagihara et al. | 430/598 |
| 5,180,659 | 1/1993 | Murai et al. | 430/522 |
| 5,238,798 | 8/1993 | Usami | 430/522 |
| 5,238,799 | 8/1993 | Usami et al. | 430/522 |

*Primary Examiner*—Janet C. Baxter
*Attorney, Agent, or Firm*—Sughrue, Mion, Zinn, Macpeak & Seas

[57] ABSTRACT

A silver halide photographic light-sensitive material comprises a support having provided thereon at least one light-sensitive emulsion layer and at least one hydrophilic colloid layer containing a solid fine grain dispersion of a dye, wherein the light-sensitive material contains at least one solid fine grain dispersion of a dye represented by formula (I) and at least one solid fine grain dispersion of a dye represented by formula (II):

(I)

(II)

where $R_1$, $R_2$, $R_{21}$, $R_{22}$, $R_{23}$, $R_{24}$, $L_1$, $L_2$, $L_3$, $L_{21}$, and n are as defined in the specification. The use of the dyes in the form of solid fine grain dispersions prevents transfer or migration of the dyes between hydrophilic colloid layers.

3 Claims, No Drawings

SILVER HALIDE PHOTOGRAPHIC LIGHT-SENSITIVE MATERIAL

This is a continuation of application Ser. No. 07/993,608, filed Dec. 21, 1992, now abandoned.

FIELD OF THE INVENTION

The present invention relates to a silver halide photographic light-sensitive material in which at least two specific dyes are used in a form of solid fine grain dispersions to prevent transfer the dyes between hydrophilic colloid layers.

BACKGROUND OF THE INVENTION

In general, in a silver halide photographic light-sensitive material, the incorporation of light absorbing compounds into silver halide emulsion layers or other hydrophilic colloid layers has so far been carried out in order to absorb light of a specific wavelength for the purposes of adjusting sensitivity, improving safelight safety, adjusting the color temperature of the light, preventing halation, and adjusting the sensitivity balance in multilayered color light-sensitive materials.

For example, when a silver halide photographic light-sensitive material, which comprises a support having provided thereon hydrophilic layers such as a light-sensitive silver halide emulsion layer, is subjected to an imagewise exposure in order to record an image in the light-sensitive silver halide emulsion layer, it is necessary to control the spectral composition of the light incident on the silver halide emulsion layer in order to improve the photographic sensitivity. In such cases, it is conventional to employ a method in which a dye capable of absorbing light of wavelengths undesired for the above silver halide emulsion layer is incorporated into hydrophilic colloid layers farther from the support than the above light-sensitive silver halide emulsion layer to form a filter layer, so that only light of the desired wavelengths is transmitted.

Further, a dye capable of absorbing light of the wavelength region in which silver halide is sensitive is used on some occasions for a silver halide emulsion layer for the purpose of preventing irradiation in order to improve the sharpness of the image.

In particular, silver halide photographic light-sensitive materials used for plate making processes, more specifically light-sensitive materials used in light rooms, contain a dye which absorbs UV rays and visible rays in a light-sensitive layer or a layer present between the light source and light-sensitive layer in order to increase safety under a safelight.

These colored layers consist of hydrophilic colloid in many cases, and a dye is usually incorporated into the layers for coloring. This dye is requested to satisfy the following conditions:

(1) The dye must have an appropriate spectral absorption consistent with the purpose for which it is being used.

(2) The dye must be photochemically inactive. That is, the dye must not have undesirable effects on the characteristics of a silver halide photographic layer in a chemical sense, such as, for example, a lowering of the sensitivity, a lowering of the image density, a reduction of the contrast, fogging, or degradation of the latent image.

(3) The dye must be capable of being readily bleached or dissolved and removed in the photographic processing steps without leaving harmful color on the processed photographic light-sensitive material.

Several methods are available for selectively coloring a specific hydrophilic colloid layer. The most frequently used method is one in which a hydrophilic polymer containing a group having a charge opposite to that of a dye ion is allowed to coexist as a mordant in a hydrophilic colloid layer and the dye is localized in a specific layer by the interaction of the mordant with the dye molecules (it is considered to be due to pulling by a charge and a hydrophobic bonding).

However, where a medium is used, a layer containing a dye contacts the other hydrophilic layers in a wet condition and this often permits a part of the dye to diffuse from the dye-containing layer to other layers. It is a matter of course that such diffusion of the dye depends on the chemical structure of the mordant but depends as well on the chemical structure of the dye used.

Where a high molecular weight mordant is used, the dye is particularly liable to remain on the light-sensitive material after photographic processing, particularly if the photographic processing is carried out in a shortened processing time. It is believed that this is because the bonding force of the mordant to the dye is significantly weakened in an alkaline solution such as a developing solution but the dye or a reversible decolored product of the dye remains in the layer containing the mordant due to the remaining, albeit weakened bonding force between the dye and the mordant.

As another means for holding a dye in a specific layer of a photographic light-sensitive layer, it has been proposed to permit the dyes to exist in the form of a solid dispersion, as disclosed in JP-A-56-12639 (the term "JP-A" as used herein means an unexamined published Japanese Patent Application), JP-A-55-155350, JP-A-55-155351, JP-A-52-92716, JP-A-63-197943, JP-A-63-27838, JP-A-64-40827, JP-A-2-110453, and JP-A-2-277045, EP-B1-0015601 and EP-A1-0276566, and Published International Patent Application W088/04794.

However, it has been observed that some kinds of dyes are still slow in terms of their discoloring speed in development processing even with these improved methods, and there has been a problem in that some dyes have tended to decompose under hot and humid conditions. In particular, there has been a problem that where many kinds of dyes are used according to the purposes, it is difficult to find out a combination of dyes by which various conditions are satisfied.

SUMMARY OF THE INVENTION

Accordingly, a first object of the present invention is to provide a silver halide photographic light-sensitive material in which a specific hydrophilic colloid layer is colored, which has an excellent decoloring performance and which contains a combination of dyes that is stable under hot and humid (high temperature and humidity) conditions.

A second object of the present invention is to provide a silver halide photographic light-sensitive material having a hydrophilic colloid layer colored with a combination of dyes which exerts no adverse affects on the photographic performance of the photographic emulsion in the material.

The above objects of the present invention have been achieved by a silver halide photographic light-sensitive material comprising at least one hydrophilic colloid layer containing a solid fine grain dispersion of a dye, wherein the light-sensitive material contains at least one solid fine grain dispersion of a dye represented by formula (I) and at least one solid fine grain dispersion of a dye represented by formula (II):

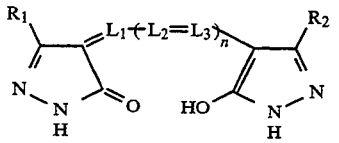

(I)

wherein $R_1$ and $R_2$ each represents an alkyl group, an aryl group, a cyano group, $—COOR_3$, $—COR_3$, $—CONR_4R_5$, $—NR_4R_5$, $—NR_4COR_3$, $—NR_4CONR_4R_5$, $—OR_3$, $—SR_3$, $—SOR_3$, or $—SO_2R_3$ (in which $R_3$ represents an alkyl group or an aryl group; $R_4$ and $R_5$ each represents a hydrogen atom, an alkyl group, or an aryl group; and $R_3$ and $R_4$, or $R_4$ and $R_5$ may be combined with each other to form a five- or six-membered ring); $L_1$, $L_2$ and $L_3$ each represents a methine group; and n represents 0 or 1, provided that $R_1$, $R_2$, $L_1$, $L_2$, and $L_3$ do not include a group having a proton capable of being ionized or a salt thereof;

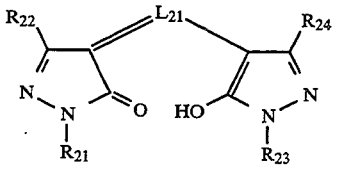

(II)

wherein $R_{21}$ and $R_{23}$ each represents a hydrogen atom, an alkyl group, or an aryl group; $R_{22}$ and $R_{24}$ each represents an alkyl group, an aryl group, $—OR_{26}$, $—COOR_{26}$, $—COR_{25}$, $—SR_{26}$, $SOR_{25}$, $—SO_2R_{25}$, $—CONR_{26}R_{27}$, $—NR_{26}COR_{25}$, $—NR_{26}CONR_{26}R_{27}$, $—NR_{25}R_{26}$, or a cyano group (in which $R_{25}$ represents an alkyl group or an aryl group; $R_{26}$ and $R_{27}$ each represents a hydrogen atom, an alkyl group, or an aryl group; and $R_{25}$ and $R_{26}$, or $R_{26}$ and $R_{27}$ may be combined with each other to form a five or six-membered ring); and $L_{21}$ represents a methine group, provided that where $R_{21}$ and $R_{23}$ are a hydrogen atom, $R_{22}$ and $R_{24}$ each are OH and COOH.

Further, the objects of the present invention have also been achieved by a silver halide photographic light-sensitive material comprising a support, a light-sensitive emulsion layer, and a non-light-sensitive hydrophilic layer containing at least one solid fine grain dispersion of a dye represented by formula (I) and at least one solid fine grain dispersion of a dye represented by formula (II), the non-light-sensitive hydrophilic layer being provided farther from the support than the light-sensitive emulsion layer.

DETAILED DESCRIPTION OF THE INVENTION

The solid fine grain dispersion of the dye represented by the above formula (I) may be incorporated in the same layer as the layer in which the solid fine grain dispersion of the dye represented by formula (II) is incorporated, or the respective solid fine grain dispersions of the dyes of formulas (I) and (II) may be incorporated in different hydrophilic colloid layers. In the present invention, the respective solid fine grain dispersions of the dyes of formulas (I) and (II) are preferably incorporated in different hydrophilic colloid layers. Particularly preferably, two hydrophilic colloid layers are provided farther from the support than a light-sensitive emulsion layer, and the solid fine grain dispersion of the dye represented by formula (I) is incorporated in the hydrophilic colloid layer closer to the light-sensitive emulsion layer, while the solid fine grain dispersion of the dye represented by formula (II) is incorporated into the hydrophilic colloid layer farther from the light-sensitive emulsion layer.

The solid fine grain dispersion of the dye of the present invention is a dispersion of a water-insoluble dye, in the form of a fine crystal, in water. The dispersion is obtained by a conventional pulverizing method (for example, ball mill, oscillating ball mill, planetary ball mill, sand mill, colloid mill, roller mill). At this time, a solvent (for example, water, alcohol) may be present. After dissolving a dye in a suitable solvent, a poor solvent for the dye may be added thereto to precipitate a fine crystal powder. In this case, a surfactant for dispersion may be used. Alternatively, after dissolving a dye with controlling a pH, fine crystallization may be conducted with changing a pH.

The thus prepared dispersion may be mixed with a suitable hydrophilic colloid (for example, gelatin, sodium salt of carboxymethylcellulose, polyvinyl alcohol, polyacrylamide).

The alkyl group represented by $R_1$, $R_2$, $R_3$, $R_4$, or $R_5$ is preferably an alkyl group having 1 to 8 carbon atoms (for example, methyl, ethyl, n-propyl, isopropyl, n-butyl, sec-butyl, t-butyl, isobutyl, n-pentyl, n-hexyl, n-heptyl, n-octyl, cyclohexyl, 2-ethylhexyl, 3-methylbutyl, cyclopentyl, and 2-ethylbutyl), and may have a substituent (for example, a halogen atom (for example, F, Cl and Br), a cyano group, a nitro group, a hydroxyl group, a sulfonamide group, a carboxylic acid group, an arylsulfamoyl group, an amino group having 0 to 6 carbon atoms (for example, unsubstituted amino, dimethylamino, and diethylamino), an alkoxy group having 1 to 8 carbon atoms (for example, methoxy and ethoxy), an aryloxy group having 6 to 10 carbon atoms (for example, phenoxy and p-methylphenyl), an aryl group having 6 to 10 carbon atoms (for example, phenyl and 2-chlorophenyl), and an ester group having 2 to 8 carbon atoms (for example, methoxycarbonyl and ethoxycarbonyl)).

The aryl group represented by $R_1$, $R_2$, $R_3$, $R_4$, or $R_5$ is preferably an aryl group having 6 to 10 carbon atoms (for example, phenyl and naphthyl), more preferably a phenyl group, and may have a substituent (for example, in addition to the groups given as suitable substituents for the alkyl group represented by $R_1$, $R_2$, $R_3$, $R_4$, or $R_5$, suitable substituents include an alkyl group having 1 to 4 carbon atoms (for example, methyl, ethyl, t-butyl, and n-propyl)).

Examples of a five or six-membered ring formed by combining $R_3$ and $R_4$ include a pyrrolidone ring and a 2-oxypiperidine ring. Examples of a five or six-membered ring formed by combining $R_4$ and $R_5$ include a pyrrolidine ring, a piperidine ring, and a morpholine ring.

The dyes of formula (I) of the present invention are characterized in that $R_1$ and $R_2$ have no group or salt of a group having a proton capable of being ionized (for example, an organic salt of Na, K, Li, and others, triethylamine, and an organic amine salt of a piperidine salt). Examples of a group having a proton capable of being ionized include a sulfonic acid group, a carboxylic acid group, a phosphoric acid group, and a sulfonamide group.

The methine groups independently represented by $L_1$, $L_2$ and $L_3$ may be unsubstituted or may have a substituent (for example, methyl, ethyl, benzyl, phenyl, and chlorine).

Specific examples of dyes represented by formula (I) are shown below by showing the respective groups but the present invention is not limited to the exemplified compounds.

| No. | $R_1$ | $R_2$ | $=L_1(L_2=L_3)_n$ |
|---|---|---|---|
| I-1 | $-CH_3$ | $-CH_3$ | $=CH-$ |
| I-2 | $-C_3H_7(n)$ | $-C_3H_7(n)$ | $=CH-$ |
| I-3 | $-C_4H_9(n)$ | $-C_4H_9(n)$ | $=CH-$ |
| I-4 | $-C_5H_{11}(n)$ | $-C_5H_{11}(n)$ | $=CH-$ |
| I-5 | $-COOC_3H_7(n)$ | $-COOC_3H_7(n)$ | $=CH-$ |
| I-6 | $-OC_4H_9(n)$ | $-OC_4H_9(n)$ | $=CH-$ |
| I-7 | $-C_4H_9(t)$ | $-C_4H_9(t)$ | $=CH-$ |
| I-8 | $-COOCH_3$ | $-COOCH_3$ | $=CH-$ |
| I-9 | $-CONHC_4H_9(n)$ | $-CONHC_4H_9(n)$ | $=CH-$ |
| I-10 | 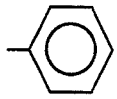 | 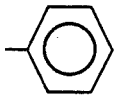 | $=CH-$ |
| I-11 | 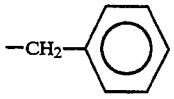 | 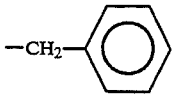 | $=CH-$ |
| I-12 | $-N(CH_3)_2$ | $-N(CH_3)_2$ | $=CH-$ |
| I-13 | $-NHCOCH_3$ | $-NHCOCH_3$ | $=CH-$ |
| I-14 | $CH_3CO-$ | $CH_3CO-$ | $=CH-$ |
| I-15 | $^nC_4H_9CO-$ | $^nC_4H_9CO-$ | $=CH-$ |
| I-16 | 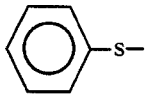 | 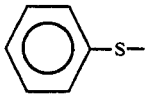 | $=CH-$ |
| I-17 | 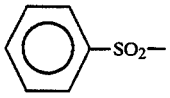 | 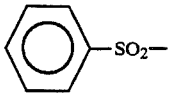 | $=CH-$ |
| I-18 | $-NHCONHC_2H_5$ | $-NHCONHC_2H_5$ | $=CH-$ |
| I-19 | $-CN$ | $-CN$ | $=CH-$ |
| I-20 | 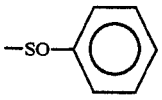 | 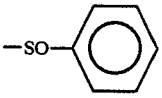 | $=CH-$ |
| I-21 | $-CONHC_6H_{13}(n)$ | $-CONHC_6H_{13}(n)$ | $=CH-$ |
| I-22 | $-NHCOC_5H_{11}(i)$ | $-NHCOC_5H_{11}(i)$ | $=CH-$ |
| I-23 | 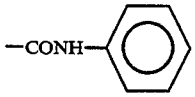 | 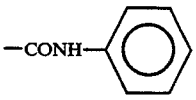 | $=CH-$ |
| I-24 | $-C_4H_9(t)$ | $-C_4H_9(t)$ | $=CH-CH=CH-$ |
| I-25 | $-NHCOC_6H_{11}(n)$ | $-NHCOC_6H_{11}(n)$ | $=CH-CH=CH-$ |
| I-26 | $-OC_3H_7(n)$ | $-OC_3H_7(n)$ | $=CH-CH=CH-$ |
| I-27 | $-C_3H_7(n)$ | $-C_3H_7(n)$ | $=CH-C(CH_3)=CH-$ |
| I-28 | $-CONHC_5H_{11}(n)$ | $-CONHC_5H_{11}(n)$ | $=CH-C(CH_3)=CH-$ |
| I-29 | $-NHCH_3$ | $-NHCH_3$ | $=CH-CH=CH-$ |

-continued

| No. | $R_1$ | $R_2$ | $=L_1\leftrightarrow L_2=L_3\rightarrow_n$ |
|---|---|---|---|
| I-30 | 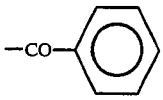 | 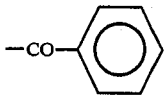 | =CH—CH=CH— |
| I-31 | $-CONHC_4H_9(n)$ | $-CONHC_4H_9(n)$ | =CH—CH=CH— |
| I-32 | 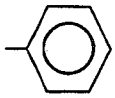 | 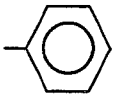 | =CH—CH=CH— |
| I-33 | $-C_4H_9(n)$ | $-CH_3$ | =CH— |
| I-34 | $-CONHC_3H_7(n)$ | $-C_4H_9(n)$ | =CH—CH=CH— |
| I-35 | $-C_3H_7(n)$ | $-C_3H_7(n)$ | $=C(CH_3)-CH=CH-$ |

The alkyl group represented by $R_{21}$, $R_{22}$, $R_{23}$, $R_{24}$, $R_{25}$, $R_{26}$ or $R_{27}$ is preferably an alkyl group having 1 to 8 carbon atoms, as explained in $R_1$ to $R_5$ of formula (I).

The aryl group represented by $R_{21}$, $R_{22}$, $R_{23}$, $R_{24}$, $R_{25}$, $R_{26}$ or $R_{27}$ is preferably an aryl group having 6 to 10 carbon atoms, as explained in $R_1$ to $R_5$ of formula (I).

In formula (II), where $R_{21}$ and $R_{23}$ are not hydrogen atoms, they are each preferably an aryl group (more preferably a phenyl group) having at least one substituent group selected from a carboxyl group, a sulfonamide group, and a sulfamoyl group.

The methine group represented by $L_{21}$ may have a substituent (for example, methyl, ethyl, benzyl, a chlorine atom, and phenyl).

Specific examples of dyes represented by formula (II) are given below but the present invention is not limited to the exemplified compounds.

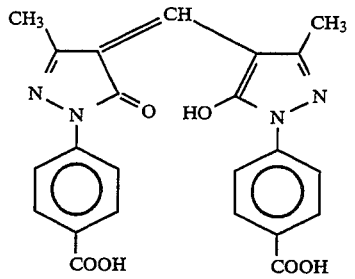

II-1

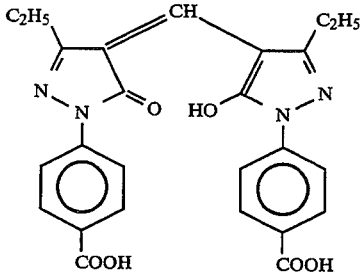

II-2

-continued

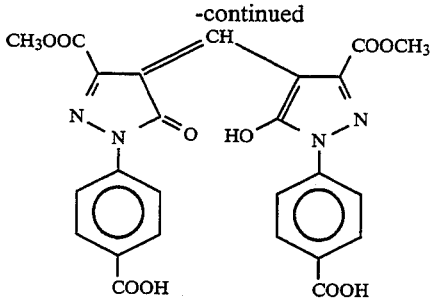

II-3

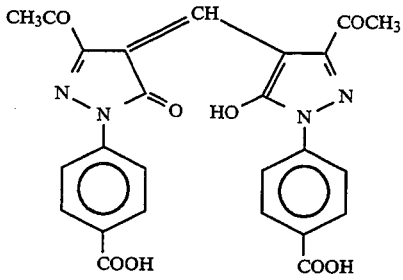

II-4

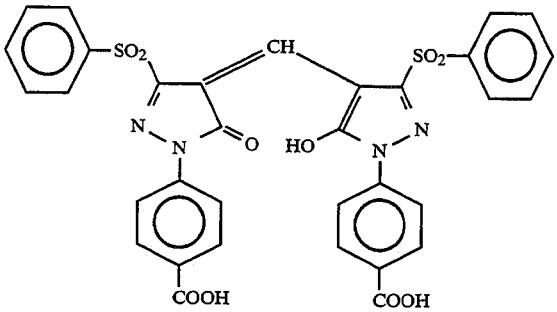

II-5

-continued
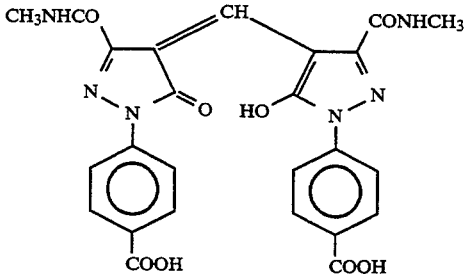
II-6
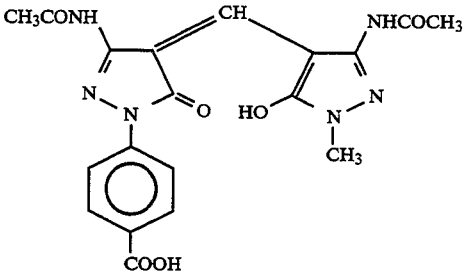
II-7
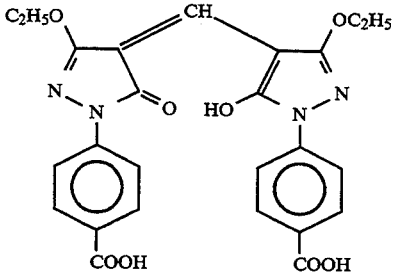
II-8
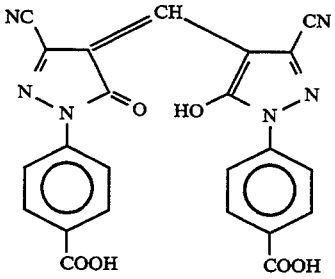
II-9
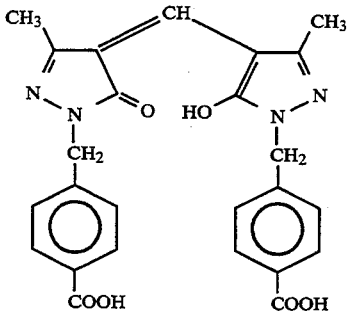
II-10
-continued
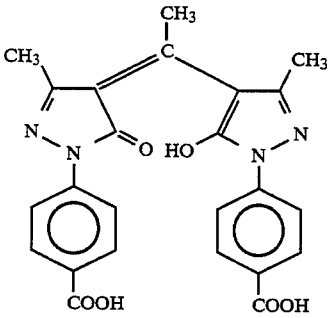
II-11
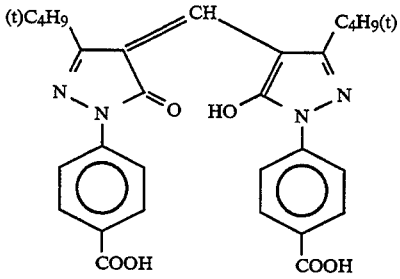
II-12
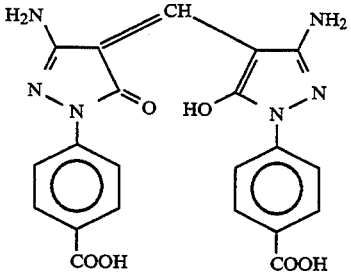
II-13
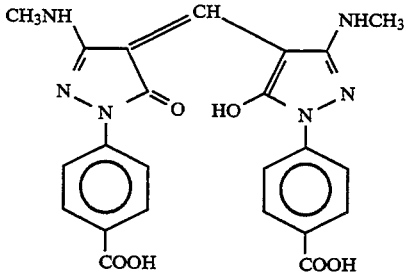
II-14
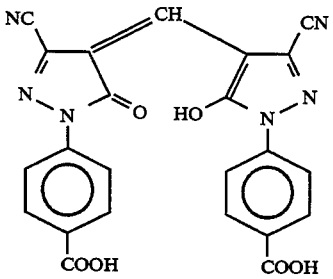
II-15

-continued

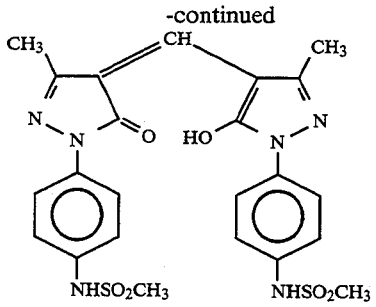

II-16

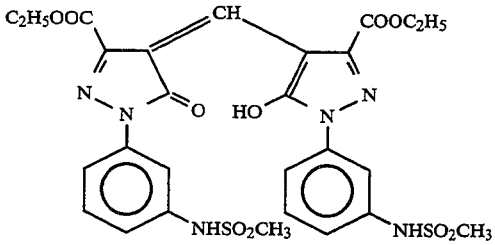

II-17

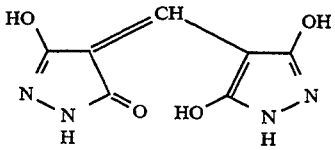

II-18

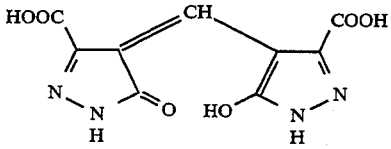

II-19

The dyes represented by formula (I) can be synthesized according to the synthesis examples described in JP-A-52-29716, JP-A-64-40827, and JP-A-2-303170. Also, the dyes represented by formula (II) are described in JP-A-52-92716, JP-A-55-120030, and JP-A-3-23441, respectively, and can be synthesized according to the methods described therein.

The compounds represented by formulas (I) and (II) are used in an amount of 1 to 1000 mg per $m^2$ of the light-sensitive material, preferably 1 to 800 mg per $m^2$ of the light-sensitive material.

A solid fine grain dispersion of a dye can be used in an arbitrary amount which is effective according to the purpose of use. Enough dye is preferably used so that the optical density of the layer containing the solid fine grain dispersion of the dye falls within the range of 0.05 to 3.5. The time at which the solid fine grain dispersion of the dye is added to the hydrophilic colloid may be at any time before coating.

The methods for dispersing a dye are described in Published International Patent Application WO 88/04794, EP-A1-0276566, and JP-A-63-197943. Suitable methods for use include the method in which a dye is mechanically pulverized with a ball mill, a sand mill or a colloid mill and stabilized with a surface active agent and gelatin, and the method in which a dye is dissolved in an alkali solution and then is precipitated by lowering the pH. However, the present invention is not limited to these methods.

The dyes of the present invention, when dispersed, have an average grain size of 10 μm or less, preferably 2 μm or less, and particularly preferably 0.5 μm or less. The lower limit of an average grain size is, for example, 0.05 μm.

Gelatin is a typical example of a hydrophilic colloid suitable for use in the present invention. Other suitable hydrophilic colloids for use in the present invention include any of the compounds which have so far been known as capable of being used as hydrophilic colloids for photography.

In addition to the solid fine grain dispersions of the dyes represented by formulas (I) and (II), a hydrazine compound is preferably incorporated in the light-sensitive material of the present invention as a nucleating agent.

The hydrazine compound used in the present invention is preferably a compound represented by the following formula (III):

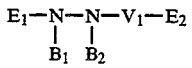

(III)

wherein $E_1$ represents an aliphatic group or an aromatic group; $E_2$ represents a hydrogen atom, an alkyl group, an aryl group, an alkoxy group, an aryloxy group, an amino group, or a hydrazino group; $V_1$ represents a —CO— group, an —$SO_2$— group, an —SO— group, a —P(O)($E_3$)— group, a —CO—CO— group, a thiocarbonyl group, or an iminomethylene group; both of $B_1$ and $B_2$ may represent hydrogen atoms, or one of them may represents a hydrogen atom and the other may represent a substituted or unsubstituted alkylsulfonyl group, a substituted or unsubstituted arylsulfonyl group, or a substituted or unsubstituted acyl group; and $E_3$ is selected from the same groups as those defined for $E_2$, and $E_3$ may be the same as or different from $E_2$.

In formula (III), the aliphatic group represented by $E_1$ preferably has 1 to 30 carbon atoms and particularly preferably is a linear, branched or cyclic alkyl group having 1 to 20 carbon atoms. This alkyl group may have a substituent.

In formula (III), the aromatic group represented by $E_1$ is a monocyclic or dicyclic aryl group or unsaturated heterocyclic group, wherein an unsaturated heterocyclic group may be condensed with an aryl group.

$E_1$ is preferably an aryl group, particularly preferably an aryl group containing a benzene ring.

The aliphatic group or aromatic group represented by $E_1$ may be substituted, and examples of typical substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric acid amide group, a diacylamide group, an imide group, and an $E_4$—NHCO—N($E_5$)—CO— group (wherein $E_4$ and $E_5$ are selected from the same groups as those defined for $E_2$ and $E_4$ and $E_5$ may be the same as or different from each other). The preferred substituents are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group having 1 to 20 carbon atoms and substituted with an alkyl group), an acylamino group (preferably having 2 to 30 carbon atoms), a sulfonamide group (preferably having 1 to 30 carbon atoms), a ureido group (preferably having 1 to 30 carbon atoms), and a phosphoric acid amide group (preferably having 1 to 30 carbon atoms). These groups may be further substituted.

The alkyl group represented by $E_2$ in formula (III) is preferably an alkyl group having 1 to 4 carbon atoms, and the aryl group represented by $E_2$ is preferably a monocyclic or dicyclic aryl group (for example, an aryl group containing a benzene ring).

Where $V_1$ is a —CO— group, $E_2$ is preferably a hydrogen atom, an alkyl group (for example, methyl, trifluoromethyl, 3-hydroxypropyl, 3-methanesulfonamidepropyl, and phenylsulfonylmethyl), an aralkyl group (for example, o-hydroxybenzyl), or an aryl group (for example, phenyl, 3,5-dichlorophenyl, o-methanesulfonamidephenyl, 4-methanesulfonylphenyl, and 2-hydoxymethylphenyl), and $E_2$ is particularly preferably a hydrogen atom.

$E_2$ may be substituted. Suitable substituents for $E_2$ include the substituents enumerated for $E_1$.

$V_1$ in formula (III) is most preferably a —CO— group.

Also, $E_2$ may be a group which permits $V_1$—$E_2$ to split off from the compound of formula (III) and may cause a cyclization reaction in which a cyclic structure containing the atoms in —$V_1$—$E_2$ is formed, and there can be given as the example thereof, for example, the compounds described in JP-A-63-29751.

$B_1$ and $B_2$ are most preferably hydrogen atoms.

$E_1$ or $E_2$ in formula (III) may include a ballast group or a polymer selected from ballast groups and polymers which are conventionally used as immobile photographic additives. The ballast group is preferably a group which has 8 or more carbon atoms and which is comparatively inactive with respect to photographic characteristics, and a suitable ballast group can be selected from, for example, an alkyl group, an alkoxy group, a phenyl group, an alkylphenyl group, a phenoxy group, and an alkylphenoxy group. Examples of suitable polymers include the compounds described in JP-A-1-100530.

A group which strengthens the adsorption of the compound to the surface of silver halide grains may be incorporated into $E_1$ or $E_2$ in formula (III). Examples of such adsorbing groups include the groups such as a thiourea group, a heterocyclic thioamide group, a mercapto heterocyclic group, and a triazole group as described in U.S. Pat. Nos. 4,385,108 and 4,459,347, JP-A-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Specific examples of compounds represented by formula (III) are shown below but the present invention is not limited to the following compounds.

III-1

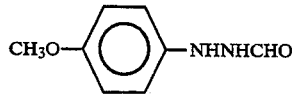

III-2

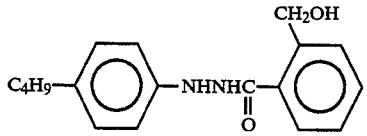

III-3

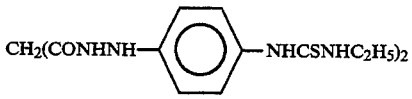

III-4

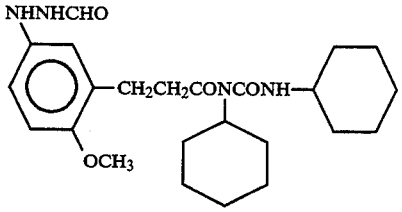

III-5

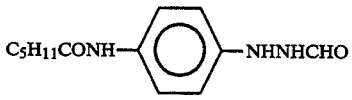

III-6

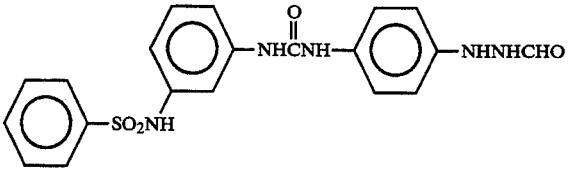

-continued
III-7
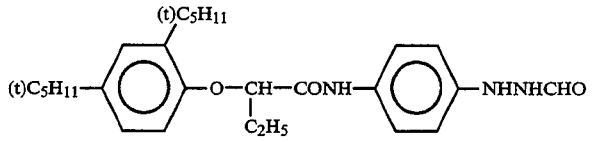
III-8
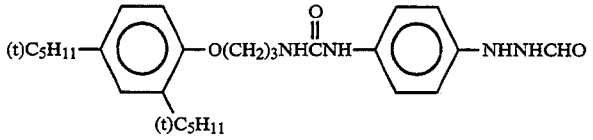
III-9
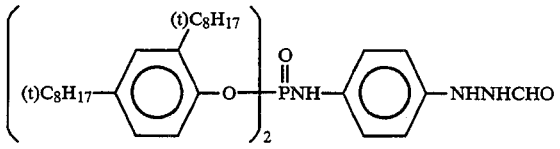
III-10
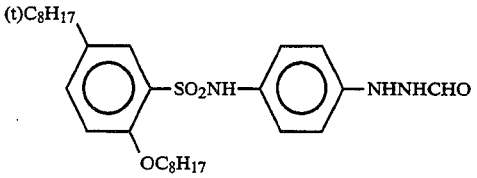
III-11
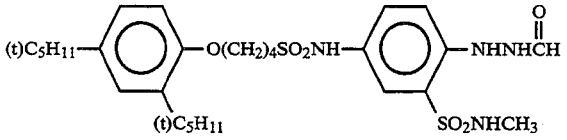
III-12
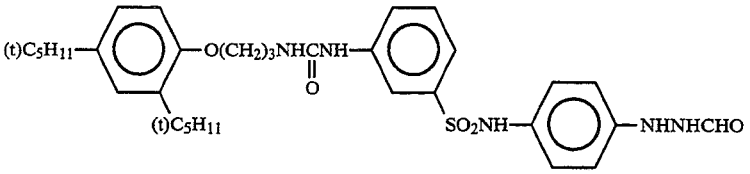
III-13
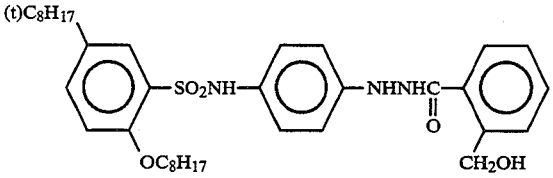
III-14
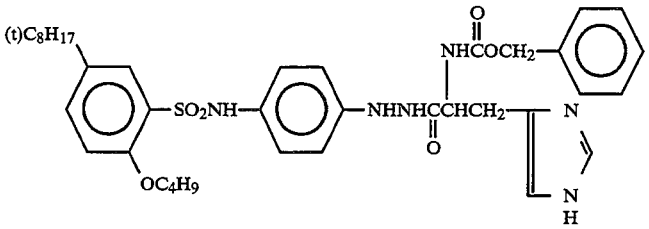
III-15
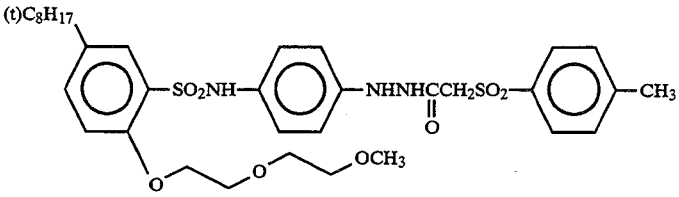

-continued
III-16
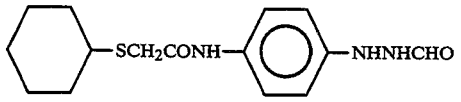
III-17
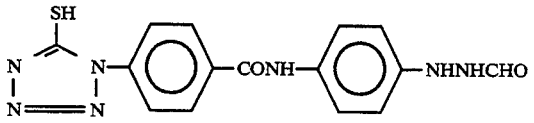
III-18
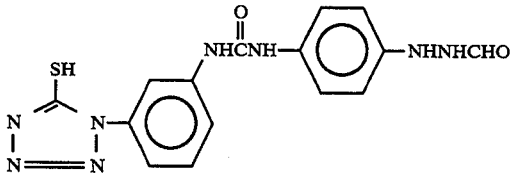
III-19
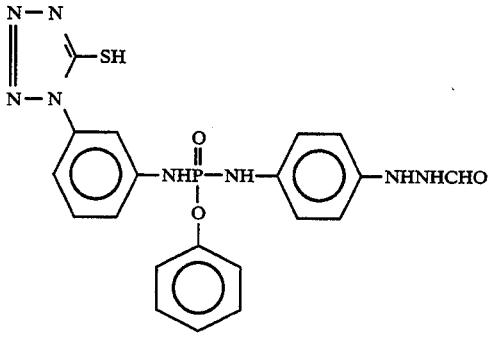
III-20
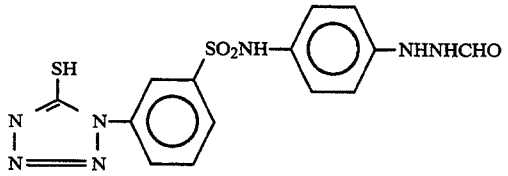
III-21
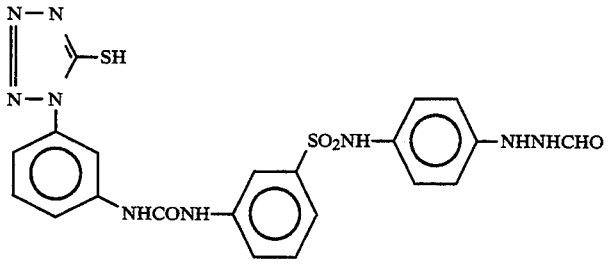
III-22
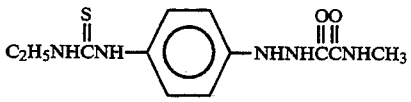
III-23
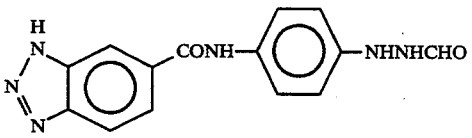

-continued

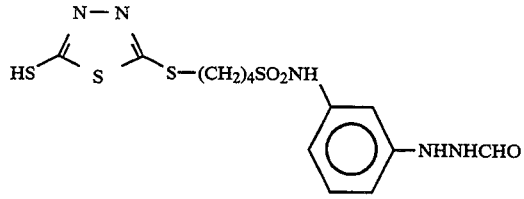

III-24

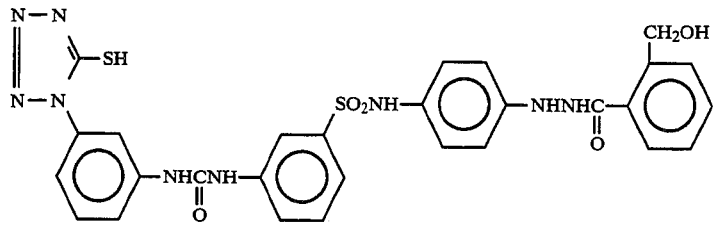

III-25

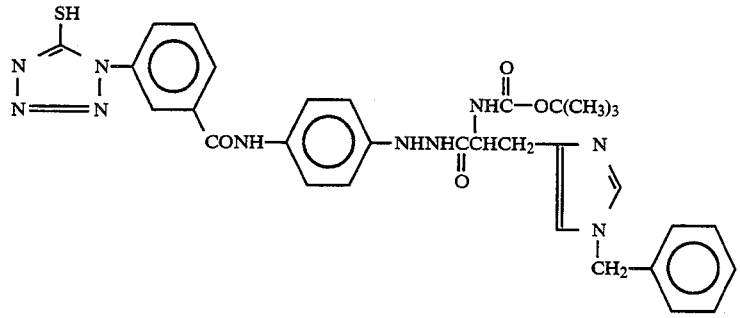

III-26

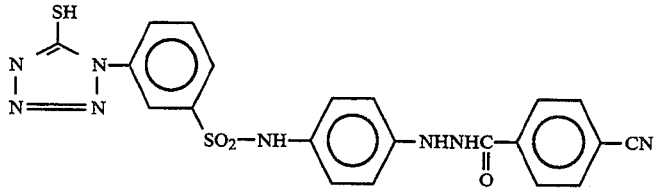

III-27

In addition to the above compounds of formula (III), hydrazine compounds which are suitable for use in the present invention include the compounds described in *Research Disclosure*, Item 23516 (November 1983, p. 346) and the publications cited therein, and in addition, the compounds disclosed in U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, and JP-A-62-270948, EP 217,310, EP 356,898, U.S. Pat. No. 4,686,167, and JP-A-62-178246, JP-A-63-32538, JP-A-53-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-00530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750, and JP-A-2-304550.

In the present invention, the addition amount of the hydrazine compound is preferably $1\times10^{-6}$ to $5\times10^{-2}$ mole per mole of silver halide, and in particular, the preferred addition amount is within the range of $1\times10^{-5}$ to $2\times10^{-2}$ mole per mole of silver halide.

The hydrazine compounds used in the present invention can be dissolved in a suitable solvent for use. Examples of suitable solvents include alcohols (e.g., methanol, ethanol, propanol, and fluorinated alcohol), ketones (e.g., acetone and methyl ethyl ketone), dimethylformamide, dimethylsulfoxide, and methyl cellosolve.

Further, the hydrazine compounds can be dissolved for use with the aid of an oil such as dibutyl phthalate, tricresyl phosphate, glyceryl triacetate, or diethyl phthalate, and an auxiliary solvent such as ethyl acetate or cyclohexanone to mechanically prepare emulsified dispersions thereof by a well known dispersing method. Alternatively, a powdered redox compound of the hydrazine compound can be dispersed in water by a method known as the solid dispersing method with a ball mill, a colloid mill or a supersonic wave.

The light-sensitive emulsion used in the present invention may be of any composition such as silver chloride, silver chlorobromide, silver iodobromide, silver iodochlorobromide, and others.

The light-sensitive silver halide grains preferably have a fine average grain size (for example, 0.7$\mu$ or less), and 0.5$\mu$ or less is particularly preferred. There is basically no limitation as to the grain size distribution but monodispersion is preferred. The expression "monodispersion" as used herein refers to a grain distribution in which 95% of the grains in terms of weight or number consist of grains having grain sizes falling within ±40% of the average grain size.

The silver halide grains incorporated in the photographic emulsion may have a regular crystal form such as a cube or an octahedron, an irregular crystal form such as a sphere or a plate, or a composite form of these crystal forms.

The silver halide grains may be of the type in which the compositions of the inside and surface layers thereof are the same as or different from each other. A mixture of two or more kinds of silver halide emulsions each prepared separately may be used.

A cadmium salt, a sulfite salt, a lead salt, a thallium salt, a rhodium salt or a complex salt thereof, or an iridium salt or a complex salt thereof may coexist in the silver halide emulsion used in the present invention at a step of formation or physical ripening of the silver halide grains.

The various additives used in the present invention and the development processing and exposing methods used for the light-sensitive material of the present invention are not specifically limited, and the additives and processing solutions and methods described in, for example, the following Japanese Patent Applications can be preferably applied.

| | Additive, Processing Solution, or Method | Location of Description |
|---|---|---|
| 1) | Spectral sensitizing dye | p. 7, left upper column, line 8 to p. 8, right lower column, line 8 of JP-A-2-55349. |
| 2) | Surface active agent and anti-electrification agent | p. 9, right upper column, line 7 to right lower column, line 7 of JP-A-2-12236; and p. 2, left lower column, line 13 to p. 4, right lower column, line 18 of JP-A-2-18542. |
| 3) | Anti-foggant and stabilizer | p. 17, right lower column, line 19 to p. 18, right upper column, line 4 and right lower column, lines 1 to 5 of JP-A-2-103526. |
| 4) | Polymer latex | p. 18, left lower column, lines 12 to 20 of JP-A-2-103526. |
| 5) | Compound having an acid group | p. 18, right lower column, line 6 to p. 19, left upper column, line 1 of JP-A-2-103526; and p. 8, right lower column, line 13 to p. 11, left upper column, line 8 of JP-A-2-55349. |
| 6) | Polyhydroxybenzenes | p. 11, left upper column, line 9 to right lower column, line 17 of JP-A-2-55349. |
| 7) | Matting agent, sliding agent and plasticizer | p. 19, left upper column, line 15 to right upper column, line 15 of JP-A-2-103526. |
| 8) | Hardener | p. 18, right upper column, lines 5 to 17 of JP-A-2-103536. |
| 9) | Water soluble dye | p. 17, right lower column, lines 1 to 18 of JP-A-2-103536. |
| 10) | Binder | p. 3, right lower column, lines 1 to 20 of JP-A-2-18542. |
| 11) | Developing solution and developing method | p. 13, ri9ht lower column, line 1 to p. 16, left upper column, line 10 of JP-A-2-55349. |

The present invention can be applied to various color and black-and-white light-sensitive materials. There can be given as typical examples thereof, a color negative film for general purposes or movies, a color reversal film for slides or television, a color paper, a color positive film, a color reversal paper, and a thermal development type color light-sensitive material. The present invention can be applied as well to lith film or scanner film, film for plate making such as a film for a dot-to-dot work step, black-and-white negative film for photographing, black-and-white photographic paper, microfilm for COM or general purposes, and printout type light-sensitive materials. Because of the advantageousness of the light-sensitive material of the present invention in a system in which the developing time is shortened to a large extent, the present invention is preferably applied to black-and-white light-sensitive materials. The application thereof to a light-sensitive material which is handled under a safelight, such as a film for plate making which has a hard gradation can demonstrate the advantageous effects of the present invention.

EXAMPLES

The present invention will be described below with reference to examples but should not be construed as limited thereto.

Example 1

Preparation of an Emulsion

A silver nitrate aqueous solution and a sodium chloride aqueous solution containing $5\times10^{-4}$ moles of rhodium (III) hexachloride per mole of silver were mixed in a gelatin solution at 35° C. by a double jet method while controlling the pH at 2.0 to thereby prepare a monodisperse silver chloride emulsion having an average grain size of 0.10 μm.

After forming the grains, the soluble salts were removed by a flocculation method well known in the art, and 4-hydroxy-6-methyl-1,3,3a,7-tetrazaindene and 1-phenyl-5-mercaptotetrazole were added as stabilizers. The amounts of gelatin and silver contained in one kg of the emulsion were 55 g and 105 g, respectively.

Preparation of a light-sensitive material:

Compound III-21 (11.8 mg/m$^2$) and Compound III-8 (9.3 mg/m$^2$) were added as nucleating agents to the above emulsion, and further the following nucleating accelerators were added:

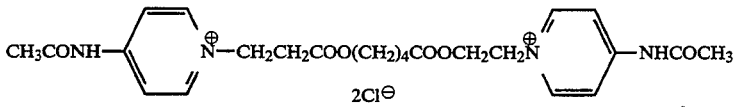

28.0 mg/m$^2$

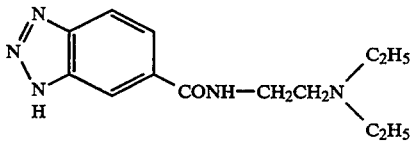

60.0 mg/m$^2$

Next, a polyethyl acrylate latex (14 mg/m$^2$) and sodium 2,4-dichloro-6-hydroxy-1,3,5-triazine as a hardener were added to the emulsion, which was coated on a transparent polyethylene terephthalate support so that the coated silver amount was 3.5 g/m$^2$, whereby a silver halide emulsion layer was provided. An intermediate layer was coated thereon, the intermediate layer containing gelatin 0.7 g/m$^2$, a polyethyl acrylate latex (average grain size: 0.05 μm) 110 g/m$^2$, Compound I-3 dispersed in a solid five grain dispersion 45 mg/m$^2$ and lipoic acid 4 mg/m$^2$. Sodium dodecylbenzenesulfonate 25 mg/m$^2$ was simultaneously coated with the intermediate layer as a coating aid.

Further, there were coated thereon a protective layer containing gelatin (0.8 mg/m$^2$), Compound II-1 dispersed in a solid five grain dispersion (0.1 g/m$^2$), the following three surface active agents as coating aids, a stabilizer, and a matting agent, followed by drying. The thus-prepared sample was designated Sample 1-1.

| Surface active agents | |
|---|---|
| 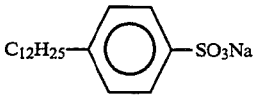 | 37 mg/m$^2$ |
| $CH_2COOC_6H_{13}$<br>\|<br>$CH_2COOC_6H_{13}$<br>\|<br>$SO_3Na$ | 37 mg/m$^2$ |
| $C_8F_{17}SO_2N(C_3H_7)CH_2COOK$ | 2.5 mg/m$^2$ |
| Stabilizer<br>Thioctic acid | 6.0 mg/m$^2$ |
| Matting agent<br>Polymethyl methacrylate<br>(average grain size: 2.5μ) | 9.0 mg/m$^2$ |

Compounds I-3 and II-1 were dispersed according to the method described in the examples of Published International Patent Application WO 88/04794, and the solid fine grain dispersions of Compounds I-3 and II-1 had average grain sizes of 0.39 μm and 0.35 μm, respectively.

Preparation of the Comparative Samples

1) A sample was prepared in which Compounds I-3 and II-1 were removed from Sample 1-1. This sample was designated Comparative Sample 1-2.

2) Sample 1-3 was prepared in the same manner as Sample 1-1 except that Compound I-3 was replaced with the following Water Soluble Dye A (34 mg/m$^2$) and Compound II-1 was replaced with the following Water Soluble Dye B (50 mg/m$^2$).

3) Sample 1-4 was prepared in the same manner as Sample 1-1 except that Compound I-3 was replaced with Water Soluble Dye A (34 mg/m$^2$) and Compound II-1 was replaced with the following Dye C (112 mg/m$^2$). The dispersion of Dye C was prepared by the following procedure:

| Solution I | |
|---|---|
| Compound C | 0.8 g |
| Dimethylformamide | 3.0 ml |
| Citric acid | 0.05 g |
| $H_2O$ | 22 ml |

-continued

| Solution II | |
|---|---|
| Gelatin | 2.2 g |
| $H_2O$ | 20 ml |

Solution I was added little by little to Solution II at 40° C. while stirring.

Water Soluble Dye A

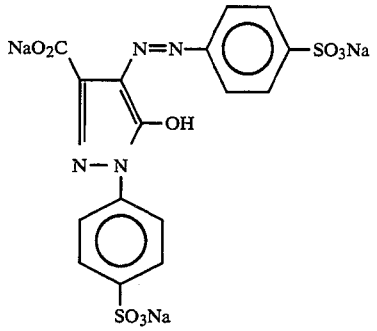

Water Soluble Dye B

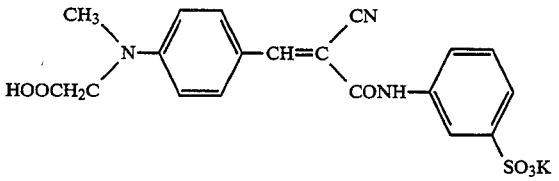

Dye C

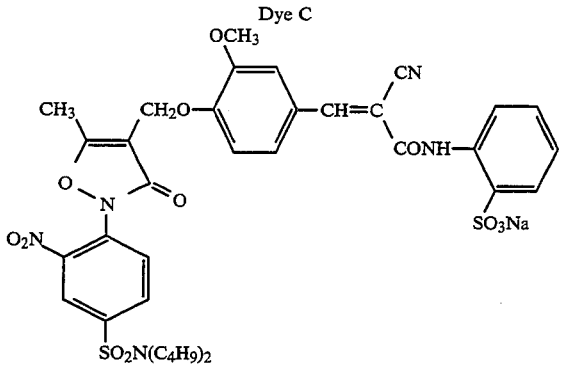

Evaluation of the Performances (1) The above four samples were exposed through an optical wedge with a light-room printer P-607 manufactured by Dainippon Screen Co., Ltd. and then developed in the following developing solution at 38° C. for 20 seconds, followed by subjecting them to fixing, rinsing and drying by conventional methods.

| | |
|---|---|
| Hydroquinone | 50.0 g |
| N-methyl-p-aminophenol | 0.3 g |
| Sodium hydroxide | 18.0 g |
| 5-Sulfosalicylic acid | 30.0 g |
| Boric acid | 25.0 g |
| Potassium sulfite | 24.0 g |
| Disodium ethylenediaminetetracetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole) benzenesulfonic acid | 0.2 g |
| N-n-butyldiethanolamine | 15.0 g |
| Sodium toluenesulfonic acid | 8.0 g |
| Water was added to | 1 liter |

-continued

| | |
|---|---|
| pH was adjusted to (by adding potassium hydroxide) | 11.6 |

The sensitivities were lowered by 0.40 in Comparative Samples 1-3 and 1-4 and by 0.42 in Sample 1-1 of the invention in terms of a log E value based on the sensitivity of Comparative Sample 1-2. In a practical use, the sensitivities of Samples 1-1, 1-3 and 1-4 fall within a suitable region.

(2) Residual Color

From sheets of each Samples 1-1 to 1-4 were superposed and the residual colors in the highlight portions were visually observed and evaluated. The evaluation standard was based on the following three grades:

○: no residual color observed

Δ: slight residual color observed but little problem in a practical use remained X: residual color observed and a problem in a practical use involved (3) Test of Safelight Safety The above four samples were subjected to a measurement of safety time with a safelight UV-cut fluorescent lamp FLR-40SW-DLX-NU/M manufactured by Toshiba Corp. under 400 lux.

(4) Tone Variability Test

The above four samples were exposed through a half tone screen with the above printer and then subjected to developing processing and the other processings in the same manner as the above test (1). After determining the exposure time necessary to permit a half tone dot area to reproduce by a ratio of 1:1 in each of the samples, each sample was exposed using exposure times two times and four times as long as the above exposure time and each sample was checked with respect to how much the halftone dot area was expanded. A greater expansion of halftone dot area corresponds to a better tone variability.

(5) Storage Stability

After the above four samples were left standing in a dark room under conditions of 50° C. and 75% RH for 3 days, they were exposed through an optical wedge with a light-room printer P-607 manufactured by Dainippon Screen Co., Ltd. and then developed with an automatic developing machine FG 680A manufactured by Fuji Photo Film Co., Ltd. in the above-mentioned developing solution at 38° C. for 20 seconds, followed by subjecting them to fixing, rinsing and drying by conventional methods.

The decrease of the sensitivities of Samples 1-1, 1-3 and 1-4 based on the sensitivity of Sample 1-2 was determined in terms of the log E value. If no change in the sensitivity and safelight safety before and after storage under hot and humid conditions was observed, this indicates that the storage stability of the dye in a layer is excellent.

The results of the various tests and evaluations are shown in Table 1.

TABLE 1

| Sample No. | Residual color | Safelight safety | Tone variability 2 times*1 | Tone variability 4 times*1 | Decrease of sensitivity*2 Before storage*3 | Decrease of sensitivity*2 After storage*3 |
|---|---|---|---|---|---|---|
| 1-1 (Inv.) | ○ | 25 min | +5% | +9% | 0.42 | 0.41 |
| 1-2 (Comp.) | ○ | 10 min | +5% | +9% | — | — |
| 1-3 (Comp.) | ○ | 22 min | +2% | +5% | 0.40 | 0.38 |
| 1-4 (Comp.) | Δ | 20 min | +3% | +7% | 0.40 | 0.29 |

*1Exposure.

*2Sensitivity in terms of log E, relative to the sensitivity of Sample 1-2.

*3Under the hot and humid conditions.

The results summarized in Table 1 show that while the tone variability was low in Comparative Samples 1-3 and 1-4, it was high in Sample 1-1 of the invention. This difference in tone variability occurred because the dyes used for Comparative Samples 1-3 and 1-4 diffused from the layers to which they were added in to the light-sensitive emulsion layers due to the dyes' water solubility or diffusibility. The result of this dye migration is that the expected expansion of the halftone dot area with even increasing exposure time has been depressed by an antiirradiation effect of the dyes. In Comparative Sample 1-4, the storage thereof under hot and humid conditions prevented the sensitivity decrease for Comparative Sample 1-4 from reaching a suitable region. This was due to decomposition of the dyes under the hot and humid conditions. Meanwhile, it can be found that the sample of the invention (Sample No. 1-1) had an excellent stability under the hot and humid conditions. Furthermore, since the dyes is Sample 1-1 were fixed to the layers to which they are added, Sample 1-1 demonstrated a high tone variability even in the storage under hot and humid conditions and had good safelight handling and an excellent performance without having a residual color.

Example 2

Compound III-18 (10.7 mg/m$^2$) and Compound III-7 (9.0 mg/m$^2$) were added as nucleating agents to the emulsion used in Example 1 and then a polyethyl acrylate latex (14 mg/m$^2$) was added, followed by further adding sodium 2,4-dichloro-6-hydroxy-1,3,5-triazine as a hardener. The emulsion thus prepared was coated on a polyethylene terephthalate transparent support so that the coated silver amount was 3.5 g/m$^2$, whereby a silver halide emulsion layer was provided.

An intermediate layer was coated thereon, the intermediate layer containing gelatin 1.0 g/m$^2$, a polyethyl acrylate latex (average grain size: 0.05 μm) 110 mg/m$^2$, Compound I-9 (average grain size: 0.30 μm) 40 mg/m$^2$ and Compound II-8 (average grain size: 0.25 μm) 60 mg/m$^2$ each dispersed in a solid five grain dispersion, lipoic acid 4 mg/m$^2$, and further the following compound as a nucleating agent, wherein sodium dodecylbenzenesulfonate 25 mg/m$^2$ was simultaneously coated as a coating aid.

Nucleating Agent

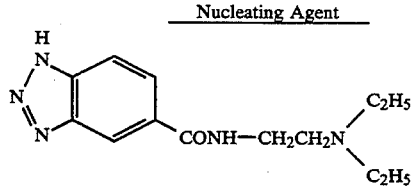

70.0 mg/m$^2$

There were coated thereon a protective layer containing gelatin (0.5 mg/m$^2$), the same surface active agents as those used for the protective layer in Example 1, a stabilizer, and a matting agent, followed by drying. The thus-prepared Sample was designated Sample 2-1.

Preparation of Samples 2-2 to 2-5:

1) Sample 2-2 was prepared in the same manner as Sample 2-1 except that Compound II-8 was removed from the intermediate layer and added to the protective layer.

2) Sample 2-3 was prepared in the same manner as Sample 2-2 except that Compound I-9 was replaced with Compound I-26 (average grain size: 0.34 μm) 45 mg/m$^2$ and further Compound II-8 was replaced with Compound II-2 (average grain size: 0.38 μm) 54 mg/m$^2$.

3) Sample 2-4 was prepared in the same manner as Sample 2-2 except that Compound I-9 was replaced with Dye D in the form of a solid fine grain dispersion (average grain size: 0.38 μm) and Compound II-1 was replaced with Dye E in the form of a solid fine grain dispersion (average grain size: 0.37 μm). The structures of Dyes D and E are shown below.

4) A sample was prepared in which Compound I-9 and Compound II-8 were removed from Sample 2-1. This sample was designated Sample 2-5.

Dye D

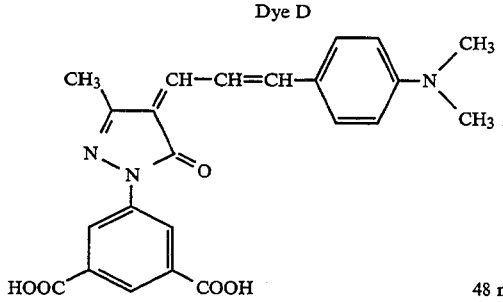

48 mg/m$^2$

Dye E

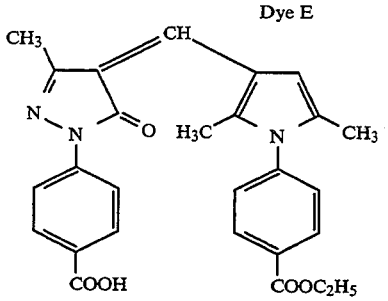

58 mg/m$^2$

Evaluation of the Photographic Performances (1) The samples were subjected to exposure and development processing in the same manner as in Example 1. The sensitivities were lowered by 0.42 in Samples 2-1, 2-2 and 2-3 of the invention and by 0.41 in the comparative samples in terms of the log E value based on the sensitivity of Comparative Sample 2-5. In a practical use, the sensitivities of Samples 2-1 to 2-4 fall within a suitable region.

(2) A residual color test was carried out in the same manner as Example 1.

(3) Test of Safelight Safety

The above five samples were subjected to a measurement of the safety time with a safelight UV-cut fluorescent lamp FLR-40SW-DLX-NU/M manufactured by Toshiba Corp. under 400 lux. Next, the above samples were left for standing in a dark room under the hot and humid conditions of 50° C. and 75% RH for 3 days and then the safety time was similarly measured by applying the safelight UV-cut fluorescent lamp.

The results are shown in Table 2.

TABLE 2

| Sample No. | Residual color | Safelight safety | |
|---|---|---|---|
| | | Before storage* | After storage* |
| 2-1 (Inv.) | Δ | 23 min | 22 min |
| 2-2 (Inv.) | ○ | 26 min | 26 min |
| 2-3 (Inv.) | ○ | 25 min | 25 min |
| 2-4 (Comp.) | X | 25 min | 14 min |
| 2-5 (Comp.) | ○ | 10 min | 9 min |

*: Under hot and humid conditions.

The results summarized in Table 2 show that while Comparative Sample 2-4 had a residual color which would cause a problem in a practical use, Samples 2-1 to 2-3 would have no problems in a practical use. Further, in Comparative Sample 2-4, safelight safety is low due to the decomposition of the dyes under the hot and humid conditions. In contrast, in the samples of the invention, safelight handling was not affected even after aging under hot and humid conditions and therefore the storage stability of the samples of the invention is excellent.

While the invention has been described in detail and with reference to specific embodiments thereof, it will be apparent to one skilled in the art that various changes and modifications can be made therein without departing from the spirit and scope thereof.

What is claimed is:

1. A silver halide photographic black-and-white light-sensitive material comprising a support having provided thereon at least one light-sensitive emulsion layer and two non-light sensitive hydrophilic colloid layers farther from the support than the light-sensitive emulsion layer, at least one solid fine grain dispersion of a dye represented by formula (I) is incorporated into the non-light sensitive hydrophilic colloid layer closer to the light-sensitive emulsion layer, and at least one solid fine grain dispersion of a dye represented by formula (II) is incorporated into the non-light sensitive hydrophilic colloid layer farther from the light-sensitive emulsion layer:

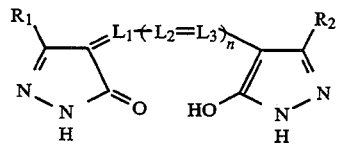

(I)

wherein $R_1$ and $R_2$ each represents an alkyl group, an aryl group, a cyano group, —$COOR_3$, —$COR_3$, —$CONR_4R_5$, —$NR_4R_5$, —$NR_4COR_3$, —$NR_4CONR_4R_5$, —$OR_3$, —$SR_3$, —$SOR_3$, or —$SO_2R_3$; $R_3$ represents an alkyl group or an aryl group; $R_4$ and $R_5$ each represents a hydrogen atom, an alkyl group, or an aryl group; and $R_3$ and $R_4$, or $R_4$ and $R_5$ may be combined with each other to form a five- or six-membered ring; $L_1$, $L_2$ and $L_3$ each represents a methine group; and n represents 0 or 1, provided that $R_1$, $R_2$, $L_1$, $L_2$, and $L_3$ do not include a group having a proton capable of being ionized or a salt thereof;

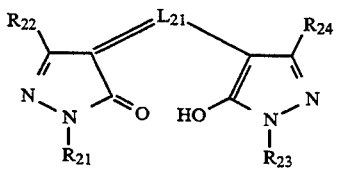

(II)

wherein $R_{21}$ and $R_{23}$ each represents a hydrogen atom or an aryl group having at least one substituent group selected from a carboxyl group, a sulfonamide group, and a sulfamoyl group; $R_{22}$ and $R_{24}$ each represents an alkyl group, an aryl group, $—OR_{26}$, $—COOR_{26}$, $—COR_{25}$, $—SR_{26}$, $—SOR_{25}$, $—SO_2R_{25}$, $—CONR_{26}R_{27}$, $—NR_{26}COR_{25}$, $—NR_{26}CONR_{26}R_{27}$, $—NR_{25}R_{26}$, or a cyano group; $R_{25}$ represents an alkyl group or an aryl group; $R_{26}$ and $R_{27}$ each represents a hydrogen atom, an alkyl group, or an aryl group; and $R_{25}$ and $R_{26}$, or $R_{26}$ and $R_{27}$ may be combined with each other to form a five- or six-membered ring; and $L_{21}$ represents a methine group, provided that where $R_{21}$ and $R_{23}$ are a hydrogen atom, $R_{22}$ and $R_{24}$ each are OH and COOH.

2. The light-sensitive material of claim 1, wherein a hydrazine compound is incorporated into the light-sensitive material.

3. The light-sensitive material of claim 2, wherein the hydrazine compound is represented by formula (III):

$$E_1—\underset{\underset{B_1}{|}}{N}—\underset{\underset{B_2}{|}}{N}—V_1—E_2 \qquad \text{(III)}$$

wherein $E_1$ represents an aliphatic group or an aromatic group; $E_2$ and $E_3$, which may be the same or different, each represents a hydrogen atom, an alkyl group, an aryl group, an alkoxy group, an aryloxy group, an amino group, or a hydrazino group; $V_1$ represents a —CO— group, an $—SO_2—$ group, an —SO— group, a $—P(O)(E_3)—$ group, a —CO—CO— group, a thiocarbonyl group, or an iminomethylene group; and $B_1$ and $B_2$ each represents a hydrogen atom, a substituted or unsubstituted alkylsulfonyl group, a substituted or unsubstituted arylsulfonyl group, or a substituted or unsubstituted acyl group, provided that at least one of $B_1$ an $B_2$ is a hydrogen atom.

* * * * *